US005744756A

United States Patent [19]

Springer et al.

[11] Patent Number: 5,744,756

[45] Date of Patent: Apr. 28, 1998

[54] BLOWN MICROFIBER INSULATED CABLE

[75] Inventors: Denis Dean Springer; Harry Alan Loder; Robert Sam Dodsworth, all of Austin, Tex.

[73] Assignee: Minnesota Mining and Manufacturing Company, St. Paul, Minn.

[21] Appl. No.: 681,725

[22] Filed: Jul. 29, 1996

[51] Int. Cl.[6] ..... H01B 7/34

[52] U.S. Cl. ..... 174/110 N; 174/110 PM; 174/110 F

[58] Field of Search ..... 174/110 N, 110 F, 174/110 PM

[56] References Cited

U.S. PATENT DOCUMENTS

| | | | |
|---|---|---|---|
| 3,953,566 | 4/1976 | Gore | 264/288 |
| 4,118,531 | 10/1978 | Hauser | 428/224 |
| 4,443,657 | 4/1984 | Hill et al. | 174/110 FC |
| 4,475,006 | 10/1984 | Olyphant, Jr. | 174/36 |
| 4,533,784 | 8/1985 | Olyphant, Jr. | 174/36 |
| 4,680,423 | 7/1987 | Bennett et al. | 174/36 |
| 4,701,576 | 10/1987 | Wada et al. | 174/117 F |
| 4,730,088 | 3/1988 | Suzuki | 174/102 R |
| 4,813,948 | 3/1989 | Insley | 604/366 |
| 4,921,645 | 5/1990 | Insley | 264/6 |
| 4,924,037 | 5/1990 | Ainsworth et al. | 174/117 F |
| 5,110,998 | 5/1992 | Muschiatti | 174/24 |
| 5,286,924 | 2/1994 | Loder et al. | 174/117 F |
| 5,306,869 | 4/1994 | Springer et al. | 174/36 |
| 5,455,383 | 10/1995 | Tanaka | 174/36 |
| 5,468,314 | 11/1995 | McGregor et al. | 156/56 |

*Primary Examiner*—Kristine L. Kincaid
*Assistant Examiner*—Marc D. Machtinger
*Attorney, Agent, or Firm*—Darla P. Fonseca

[57] ABSTRACT

A high speed signal transmission cable including spaced, parallel conductors and an insulation layer comprising blown micro fiber web surrounding the conductors, preferably further including a layer of another dielectric material surrounding the microfiber material.

5 Claims, 2 Drawing Sheets

BLOWN MICROFIBER INSULATED CABLE

FIELD OF THE INVENTION

The invention relates to a flat ribbon cable structure including a series of parallel conductors surrounded and attached to each other by a dielectric. A metal shield may surround the dielectric.

BACKGROUND OF THE INVENTION

Many attempts have been made to produce high speed transmission line cables which exhibit the following properties: 1) minimum signal distortion; 2) acceptable crush resistance; 3) thermal aging stability; and 4) physical robustness.

Coaxial cables are primarily utilized to provide uniform transmission line properties. However, as computer processing speeds have increased, a need has developed to produce cables which can handle the increased data transmission requirements which include shorter risetimes, and low noise or crosstalk. Larger connectors were required, making use of coaxial cables more expensive to individually terminate. More recently, pleated foil cables have been introduced which closely approximate the signal fidelity properties of high speed conventional coaxial cables while allowing the use of smaller conductors, and mass terminations, reducing costs for both the cable and the termination.

Both ribbon and coaxial cables have been insulated with a variety of materials having low dielectric constants and attenuation properties, e.g., polytetrafluoroethylene, polypropylene, polyethylene and fluoroethylpropylene. At first, such materials were used in solid form. In order to further reduce the dielectric constant of the cable, thus allowing signal speed increase, air began to be included in the dielectric. A variety of methods have been used to include air; foaming of a variety of insulative materials, such as disclosed in U.S. Pat. Nos. 4,680,423, 5,110,998, which uses an ultramicrocellular foamed structure. However, such materials suffered from lack of crushed resistance, because of the high percentage of voids.

Use of polytetraethylene (PTFE) as a dielectric has been disclosed, e.g., in U.S. Pat. Nos. 3,953,566 and 4,730,088, but such material is difficult to process and extremely costly. Boring of holes in PTFE by means of heat rays, particle rays or laser drilling of holes has also been disclosed to reduce loss of strength and compressibility in U.S. Pat. No. 4,740,088, such processing adds processing costs to already costly materials.

Likewise, sintered PTFE materials have also been employed, such as those described in U.S. Pat. Nos. 4,443,657 and 4,701,576; however, the processing of these materials is costly, and the formation of sintered shapes may result in loss of flexibility and electrical discontinuities.

Cable constructions, both coaxial and ribbon cables, are also frequently shielded, i.e., they are enclosed in highly conductive shields to prevent electromagnetic interference (EMI) from radiating from the cable, and to improve controlled impedance. Shields have included metal foils, braided wire, and the like. See, e.g., U.S. Pat. Nos. 4,701,576 and 5,455,383.

Shielded cable constructions are illustrated in U.S. Pat. Nos. 4,475,006 and 4,533,784, both of which are incorporated herein by reference, wherein, a copper foil is corrugated and/or pleated producing an extensible foil construction. Pressure-sensitive adhesive is applied to the surface of the pleated foil, and the foil is wrapped about a conventional ribbon cable rendering a shielded cable construction the pleated foil is secured to the insulation encasing the conductor(s). Tests have indicated that cables produced using the pleated foil technology exhibit transmission line qualities which are very similar to coaxial transmission lines.

However, in shielded cables, such as those described above, the use of low dielectric constant material is required to achieve both high impedance and high velocity of propagation.

U.S. Pat. No. 5,286,924, incorporated herein by reference, describes a cable construction utilizing a cellular construction utilizing microporous polypropylene. The microporous dielectric has a void volume in excess of 70%, resulting in a propagation velocity of the insulated conductor greater than 85% of the propagation velocity in air. The dielectric exhibits a crush resistance which allows the material to recover 92% of its original thickness after being under 63.8 kPA pressure for ten minutes. The dielectric material is produced by melt blending mineral oil with polypropylene resin and stabilizers. Once a blended film has been cast, a portion of the mineral oil is extracted, thereby leaving microvoids in its place which comprise approximately 50% of the material. Upon completing the oil extraction process, the now porous film is biaxially oriented to expand the microvoids and create a structure with 75–80% void content. Structures produced using the above techniques are capable of producing dielectric materials with dielectric constants as low as 1.16. Although these dielectric materials exhibit excellent electrical properties when used as cable dielectrics, they are expensive to produce as compared to solid dielectrics.

Combining this trend toward low dielectric constant materials with the pleated foil technology, one new development utilizes a microporous polypropylene dielectric covered by a copper pleated foil shield as disclosed in U.S. Pat. No. 5,306,869, which is incorporated herein by reference. Although this cable construction is highly effective, it still suffers from the disadvantage that the microporous material used as a dielectric is relatively expensive to produce.

The present inventors have now found a way to produce a high-speed transmission line which is highly effective and capable of production at a reasonable cost.

SUMMARY OF THE INVENTION

In the cables of the invention, a pleated or coaxial cable is insulated by a blown, non-woven, fibrous dielectric material, or web. The material is formed by melting polypropylene, then extruding the melted material through small die openings, i.e., from about 4 to about 24 microns in diameter, into a high pressure air stream. Microfibers are produced as the extruded polypropylene is mixed in the air stream, and the fibers are collected on a smooth roller in a continuous process. This so-called "blown microfiber" web is then hot calendared to the desired thickness. Using this process, it is possible to produce blown microfiber webs of virtually unlimited combinations of fiber size, fiber density and web thickness.

In alternative embodiments of the invention, the blown microfiber web may also include bulking fibers, i.e., crimped larger diameter fibers which are randomly and thoroughly intermixed and intertangled with the microfibers, or include multiple layers of microfiber web, combination web.

The blown microfiber dielectric material may be utilized with coaxial or ribbon cables which include a shield as well as those which do not.

Ribbon cables according to the invention exhibit high speed transmission line properties similar to those produced by the combination of porous dielectric materials and the pleated foil shield. The resulting flat cable retains the advantage of the low-cost mass termination qualities of ribbon cables, and may be manufactured at a lower cost relative to cables utilizing more conventional solid or porous dielectrics.

The cables of the invention exhibit low signal distortion with good physical robustness, i.e., good rates of crush resistance and recovery superior to or equal to present high speed porous dielectrics.

It is one objective of the present invention to provide a new cable construction which utilizes a blown microfiber dielectric material to provide a cable capable of high speed transmission.

It is another objective of this invention to provide a new cable construction which offers the advantages of the high speed transmission capabilities of conventional high speed coaxial cables by utilizing a blown micro fiber dielectric material and a pleated foil shield. This new cable combines a low cost dielectric with standard cable production processes to create an inexpensive, high performance product.

It is another objective of the invention to provide a cable construction using two types of dielectric material, a blown microfiber insulation surrounded by a second dielectric thin film or microporous film.

The following terms have these meanings as used herein:

1. The terms "dielectric" and "dielectric material" are synonymous and refer to substances having very low electrical conductivity; that is, they are insulators.
2. The term "microfiber" means a fiber having an average diameter of less than about 50 microns, preferably less than about 20 microns.
3. The term "blown microfibers" refers to discontinuous microfibers prepared by extruding liquid thermoplastic material through orifices in a die into a high-velocity gaseous stream which attenuates the extruded material, which subsequently solidifies as a mass of fibers. The fibrous webs so formed may also contain other ingredients such as larger fibers, or fibers formed from differing materials, mingled therewith.
4. The term "microporous" means containing a plurality of nodes or modules in three dimensions.
5. The term "web" refers to the mass which is formed after the fiber forming material has solidified.

All parts, percents and ratios herein are by weight, unless otherwise specifically stated.

BRIEF DESCRIPTION OF THE DRAWINGS

The present invention will be described with respect to the accompanying drawings, wherein like numbers refer to like parts in the several views, and wherein.

DETAILED DESCRIPTION OF THE INVENTION

Figure 1:
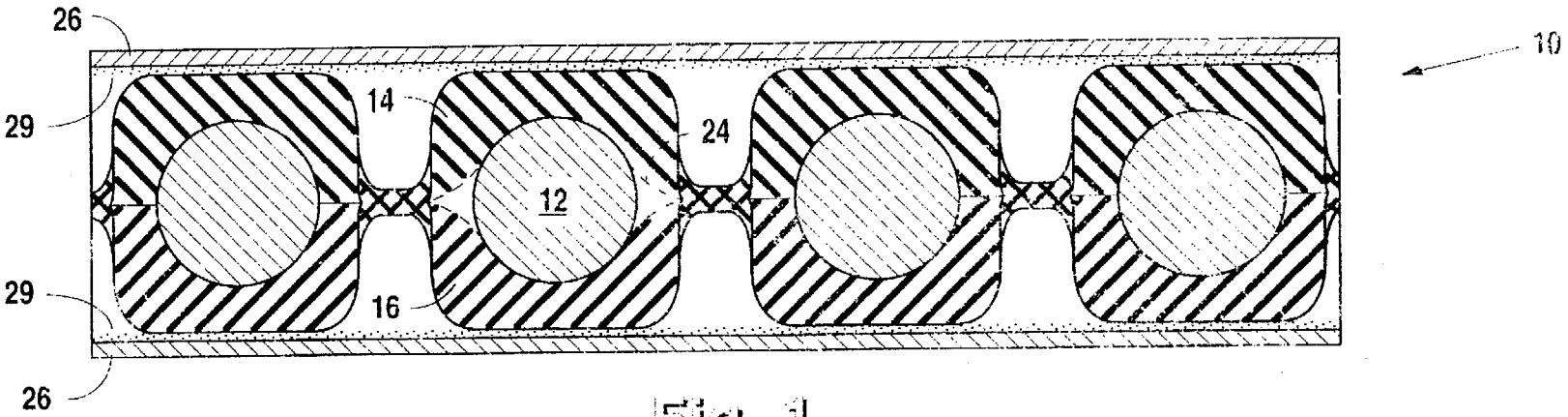
FIG. 1 is a cross-sectional view of a ribbon cable according to the present invention.

The current invention utilizes a dielectric material produced by a process in which one or more polymers, and property-enhancing additives, are melted extruded through small die openings into a high pressure air stream, and collected onto a smooth roller, resulting in a dielectric web comprised of blown fibers. If only one polymer is used, the web will be homogeneous; however, more than one polymer may simultaneously blown to form a micro fiber blend. The blown microfiber dielectric material has a low dielectric constant, excellent crush resistance, and excellent thermal resistance in the cable format.

The apparatus used to form such a material may be conventional such as that taught in "Superfine Thermoplastic Fibers", Wente, Van A., *Industrial Engineering Chemistry*, Vol. 48, pages 1342 et seq., (1956), or Report No. 4364 of the Naval Research Laboratories entitled "Manufacture of Superfine Organic Fibers", published May 25, 1954, Wente, Van. A., et al, incorporated herein by reference.

Since the material is hot when blown, the resultant material is a large number of elongated fibers entangled and fused to their close neighbors at a number of points along the lengths of the fibers. An average fiber diameter of eight microns and a density of the web of about 0.25 gram per cubic centimeter were found to produce the most effective dielectric, although fiber diameters in the range of four to 20 microns and densities of from about 0.2 to about 0.5 gram per cubic centimeter can be used.

In one alternative embodiment of the invention, the blown microfiber web incorporates microfibers, and at least about 10% by weight bulking fibers, i.e., crimped, generally larger-diameter fibers which function as separators within the web, producing a lofty resilient web by separation of the microfibers. This material is capable of filling a much larger volume than one made up solely of microfibers. Further, sufficient micro fibers are used to make the air retained inside comparable to an all-micro fiber web, so that the thermal insulating capability of the fiber web is similar. Further, the microfibers are spaced apart by the bulking fibers, which reduces the heat transfer coefficient of the web.

Webs may comprise a single layer, or may be a multi-layer product, in which the layers are typically indistinguishable to casual inspection. Multi-layer products can be formed by passing a finished single layer web under the mixing and depositing apparatus further times, or by having multiple mixing and depositing stations situated along a continuous belt. Layers may also be laminated together, if desirable. Each layer may include solely microfibers, or microfibers and bulking fibers.

Useful polymers for forming blown microfibers include polyalphaolefins, polyesters, polyamides, polyvinylidene fluoride, and the like, as well as blends thereof. Preferred polymers include polyalphaolefins, especially polypropylene, polyethylene, and blends thereof. Useful polymers for forming blown bulking fibers, where desired, may be selected from the same group; polyester bulking fibers are preferred.

By combining different resins in the process, properties may be enhanced. For example, the addition of polymethyl pentene to polypropylene improves high temperature performance and increases crush resistance. The cable itself, generally indicated as 10 in FIG. 1, has exceptional electrical properties, meeting or surpassing many needs for high speed, low loss cables.

Compositions useful for blowing may also contain adjuvants such as antioxidants, spray-on fiber finishes, solid particles, dyes, and the like. When such adjuvants are desirable, they are present in amounts of from about 0.5% to 10%, based on the weight of the blown polymers.

Figure 2:
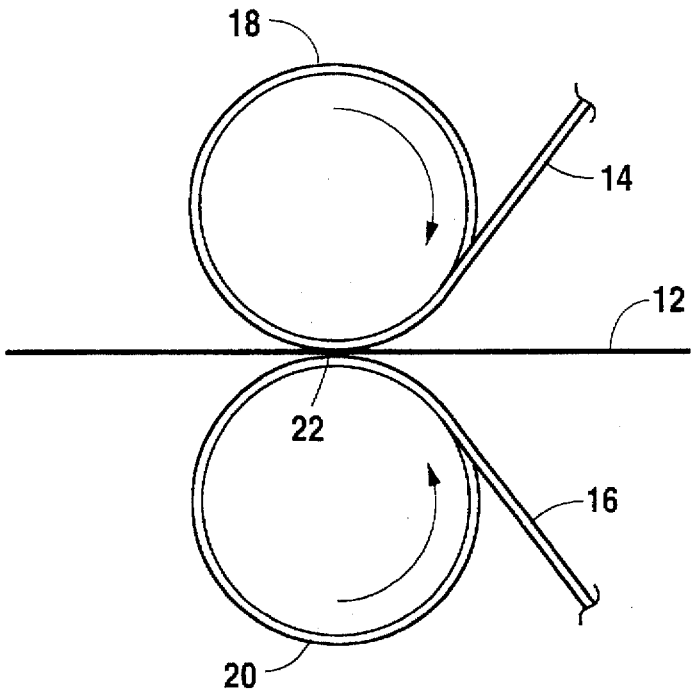
FIG. 2 is a schematic view of a manufacturing process for the cable of FIG. 1.

The aforementioned dielectric material can easily be manufactured into the ribbon cable 10 of the current invention by simple lamination as illustrated in FIG. 2. A plurality of parallel conductors 12 constructed of any conventional electrically conductive material are sandwiched between two layers 14, 16 of blown microfiber insulation. The conductors 12 and the two layers of dielectric 14, 16 are fed continuously into a line where the layers of dielectric 14, 16 are bonded under heat and pressure. The bond line is not readily visible with the naked eye, but can be seen with the aid of a magnifying glass. Typically, two tool rolls 18, 20 of the desired cable 10 profile, with lands forming the bond area, 29 and recesses between the lands forming the conductor pods, are milized. Details of the rolls 18, 20 are disclosed in U.S. Pat. No. 5,286,924, incorporated herein by reference. These tool rolls 18, 20 are both heated to approximately 150° C., and are aligned to compress the material layers 14, 16 at the nip 22 where the bond occurs.

Occasionally, in the manufacturing of cables in the aforementioned fashion, a "bird's eye" 24 may appear around the conductors. For the purposes of this discussion, the "bird's eye" 24 is defined as the air gap which is formed at the sides of the conductor 12 and runs laterally to the edge of the bond zone, and is illustrated by dashed lines in FIG. 1.

The current invention exhibits a uniform cross-sectional appearance. There is no "bird's eye" 24 or air gap found around the conductor 12. The fibers fill this gap, therein causing the conductors 12 to be centered and providing a uniform appearance about the conductors 12.

The product of the present invention is easily prepared for termination. One manner in which this may be achieved is to apply heat via a tool such as a soldering iron to end fibers of the cable, thereby resulting in the meltback of the polymer fibepolymer fiber web, thus exposing conductors for termination. The cable is compatible with insulation displacement contacts, which, of course, require no cable preparation.

Although the cable 10 will be useful as described thus far, its utility can be enhanced by the addition of a metal shield 26 surrounding the dielectric layer 14, 16.

In order to achieve consistent excellent performance of any fiat, shielded ribbon cable, it is mandatory that a shield 26 be situated at a precisely controlled distance from the conductors 12 in the cable 10. This geometry is achieved by using an adhesive 29 to bond an extensible foil 26 to the outer surface of the cable 10, thereby controlling the distance of the foil from the conductors for regulation of electrical parameters, as described in the above-mentioned U.S. Pat. Nos. 4,475,006 and 4,533,784.

The blown microfiber cable 10 performs well electrically; however, many adhesives 29 have difficulty in successfully attaching foil 20 to the insulation 14; acrylic adhesives adhere more than other adhesives, to date.

In one embodiment, a very thin film layer was placed on the outside of the blown microfibers. A variety of films would be useful for such a thin film layer, i.e., films which have a good adhesion to conventional adhesives such as silicone adhesives, acrylic adhesives, and the like.

However, useful non-porous films must not have such high heat transfer coefficients that heat is transferred quickly to the insulation, resulting in a degradation of the electrical properties.

In one preferred embodiment, a cellular material is used as the outer layer, preferably, microporous insulation formed from thermoplastic polymers. The expanded thermoplastic material does not have this damaging high heat transfer coefficient but does have the ability to bond well to adhesives. Useful thermoplastic materials for the microporous material includes crystallizable polymers with high degree of crystallinity and high tensile strengths. Some examples of useful polymers include polypropylene, polystyrene, poly (ethylene terephthalate), polyamides, polyvinylidene fluoride, blends thereof, and the like. The material is biaxially expanded and so contains nodes interconnected by fine diameter fibrils. Since this dielectric material has a nonuniform density on a microscopic scale, the rate of heat transfer is controlled by the cross-sectional area of the fibrils. Thus, the material has a low heat transfer coefficient, and will not cause degradation of the electrical properties of the insulation.

This preferred embodiment combines the benefits of microporous insulation, i.e., the low dielectric constant and adhesion to conventional adhesives, with the benefits of blown micro fiber insulation, i.e., low cost production and availability in any thickness.

Figure 3:
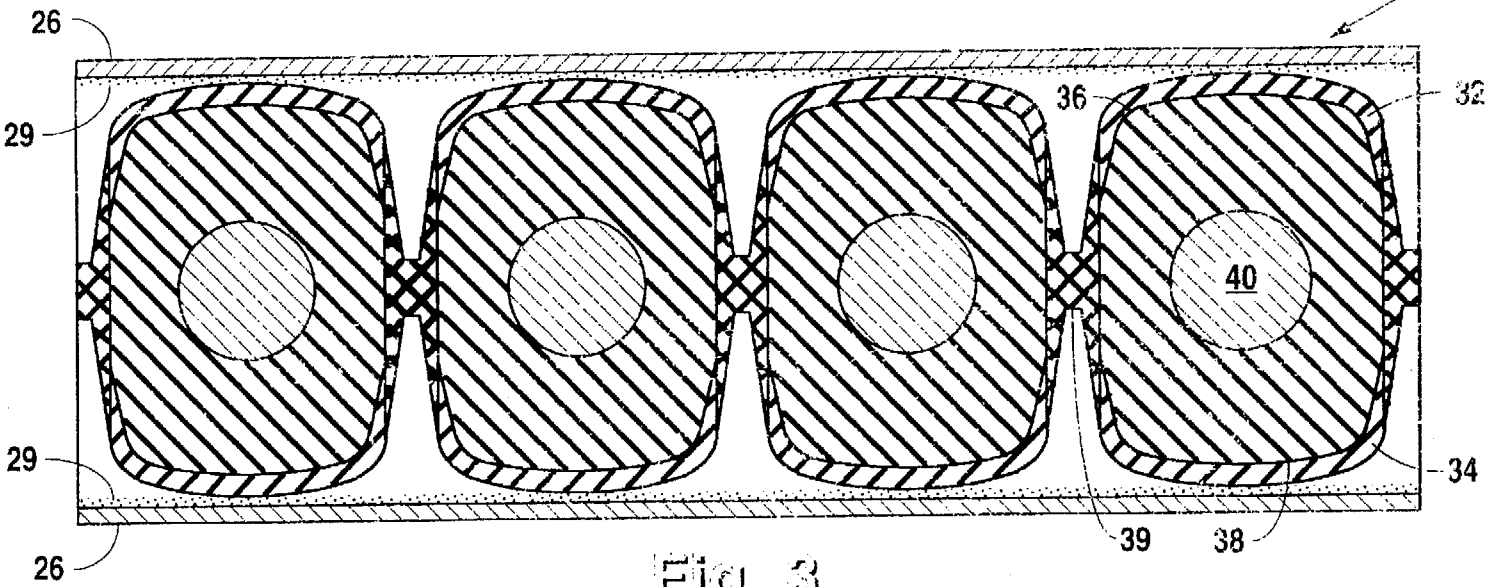
FIG. 3 is a cross-sectional view of an alternate cable construction according to the present invention.

As shown in FIG. 3, a cable 30 sandwich is constructed using from about 0.1 to about 0.2 mm thick microporous dielectric sheets 32, 34 as the outside layers, i.e., the higher cost microporous dielectric is utilized only on the surface of the cable where needed for adhesion, and blown microfibers are used for the bulk of the insulation, 36, 38. Adequate thickness of blown micro fiber insulation 36, 38 as is necessary to achieve the desired electrical properties is then put immediately contiguous with the microporous insulation 32, 34. The microporous material 32, 34 is used as the very outer layer so that its surface is available for bonding to adhesive placed between the conductors 40 and, if present, a metal foil shield such as the shield 26 of FIG. 1 and U.S. Pat. Nos., 4,475,006 and 4,533,784, when such as shielded construction is desired. In this manner a cable 30 can be constructed with consistent electrical properties. Since the bulk of the insulation, from 60% to 90%, is of the blown microfiber construction 36, 38, much lower costs can be achieved.

Tooling rolls 18, 20 having surfaces lands which provide heat at the bonding area, as described in U.S. Pat. No. 5,286,924, have been found effective to bond the four layers of dielectric 32–38. The combination of the heat plus pressure between the tooling rolls 18, 20 together causes melting to occur on the lands. This melting causes the four layers of material 32–38 to be fused together into a homogeneous area 39. The very low heat transfer coefficients of both the microporous 32, 34 and blown microfiber 36, 38 materials prevents excessive heat from being transferred to the bulk of the insulation thereby preserving the low dielectric constant of the material surrounding the conductors 40. To simplify the process, it is possible to blow the microfiber material 36, 38 directly onto the microporous material 32, 34. Since the blown microfiber material 36, 38 is hot and soft when blown, it will fuse to the microporous material 32, 34.

Trends in the electronics industry are for shielded products which have low attenuation. and impedances of between 50 to 100 ohms. As the length of cables increase, the attenuation that is attributed to the cable conductor rises. This forces the cable designer to use larger diameter conductors to reduce the attenuation. In order to accommodate the larger conductors and maintain desired impedance levels of 50 to 100 ohms, it is necessary that the insulation for the cables either be very thick, or if thinner insulation is desired, it must have a very low dielectric constant. Low dielectric constant insulations such as microporous and blown microfiber are therefore very desirable for use as cable insulations.

However, an additional advantage to the use of blown micro fiber insulation over microporous materials is the lack of need for an oil extraction step in the blowing process. In the manufacture of microporous films, mineral oil must be extracted from the film, using a slow and expensive extraction process. As the thickness of the films increase, the rate at which oil can be removed decreases, resulting in a rapid level of cost increase due to both increased material need and increased processing cost for oil extraction. This relationship of cost to thickness makes cable products that require thick insulations less cost effective.

The use of blown microfiber as a cable insulation addresses these two needs. Blown microfiber can be produced in any thickness. In fact, cost, as a function of area and thickness, actually decreases as the thickness increases, making thick insulation layers eminently possible.

The unique combination of the blown microfiber material with microporous as a cover layer meets all of the requirements for the industry trends. A 75 ohm, 26 AWG cable with the microporous/blown microfiber combination has a lower material cost than a 75 ohm fluoroethylpropylene solid insulation cable with smaller wires (30 AWG), and the microporous blown microfiber has much lower attenuation.

Thus there has been described a cable construction which provides electrical properties equal to the most presently advanced cables at a much lower cost. Although the invention has been described with respect to only a limited number of embodiments and Figures, it should be understood that many modifications are possible. For example, although one embodiment of a cable according to the invention has been shown with a shield and another embodiment without, either of the cable constructions described with respect to FIGS. 1 and 3 can be provided and is useful with or without a metal shield. Also, although only cables which include a plurality of conductors have been illustrated, cables with but a single conductor or more or less conductors than illustrated can be produced.

EXAMPLE 1

A microporous polypropylene film having a thickness of about 0.125 mm, over a microfiber insulation 0.475 mm in thickness, i.e., the film on the outside with blown micro fiber insulation towards the conductors, was tested. The cable had a propagation delay of 3.43 microseconds/meter (1.25 μs/ft) when shielded with adhesive bonded pleated foil. Propagation delay constructions for this sample as constructions formed entirely from microporous films or entirely from microfibers.

COMPARATIVE EXAMPLE 2

A solid polypropylene film was used at a thickness of about 0.01 mm, over a microfiber insulation, i.e., the film on the outside with blown microfiber insulation towards the conductors. This construction failed because the electrical properties of the blown microfiber insulation were degraded. Propagation delay was approximately 4.43 μs/meter (1.35 μs/ft).

The reason for the failure was that the solid film, even though it was very thin, would not stretch, and had a high enough heat transfer coefficient that heat was transferred into the blown microfiber causing compression and melting. Compression and melting both resulted in densification of the blown web which increases the dielectric constant and therefore degraded the electrical performance of the cable.

What is claimed is:

1. A ribbon cable for transmitting electrical signals comprising:

a number of spaced, parallel conductors;

a microfiber insulation layer comprising a non-woven, blown microfiber web surrounding said conductors, said microfiber web including a plurality of elongated, entangled polymeric fibers fused each to a number of proximate one of said fibers at points along the length of said fibers, said insulation layer being compressed and more frequently fused to itself between said conductors, and an outer layer of microporous, heat sealable insulation formed from a thermoplastic polymer selected from the group consisting of polypropylene, polystyrene, poly (ethylene terephthalate) polyamides, polyvinylidene fluoride and blends thereof surrounding said microfiber insulation layer, said ribbon cable being substantially free of air gaps around said conductors.

2. A ribbon cable according to claim 1 further including a metal layer surrounding said outer layer to provide an electromagnetic shield for said conductors.

3. A ribbon cable according to claim 2 further including an adhesive attaching said shield to said outer layer.

4. A ribbon cable according to claim 1 wherein said blown microfiber web further includes blown bulking fibers.

5. A ribbon cable according to claim 4 wherein said bulking fibers comprise at least about 10 percent by weight of said web.

* * * * *